US005771271A

United States Patent [19]

Iodice

[11] Patent Number: 5,771,271

[45] Date of Patent: Jun. 23, 1998

[54] PHOTOTIMER FOR RADIOLOGY IMAGING

[75] Inventor: Robert M. Iodice, Syracuse, N.Y.

[73] Assignee: Infimed, Inc., Liverpool, N.Y.

[21] Appl. No.: 842,802

[22] Filed: Apr. 16, 1997

[51] Int. Cl.[6] ..... H05G 1/30

[52] U.S. Cl. ..... 378/96; 378/98.8; 250/370.09

[58] Field of Search ..... 378/96, 97, 98.7, 378/98.8; 250/370.07, 370.08, 370.09

[56] References Cited

U.S. PATENT DOCUMENTS

| | | | |
|---|---|---|---|
| 2,943,205 | 6/1960 | Kazan et al. | 250/206 |
| 4,065,671 | 12/1977 | Mayeux et al. | 250/370 |
| 4,799,094 | 1/1989 | Rougeot | 357/30 |
| 4,901,126 | 2/1990 | Schulz | 357/29 |
| 5,017,989 | 5/1991 | Street et al. | 357/30 |
| 5,079,426 | 1/1992 | Antonuk et al. | 250/370.09 |
| 5,179,582 | 1/1993 | Keller et al. | 378/96 |
| 5,187,380 | 2/1993 | Michon et al. | 257/428 |
| 5,229,626 | 7/1993 | Ebitani et al. | 257/84 |
| 5,262,649 | 11/1993 | Antonuk et al. | 250/370.09 |
| 5,352,897 | 10/1994 | Horikawa et al. | 250/370.06 |

*Primary Examiner*—Don Wong
*Attorney, Agent, or Firm*—Trapani & Molldrem

[57] ABSTRACT

A phototimer for x-rays or gamma rays controls the exposure of a radiological imaging device. The phototimer sensor comprises a film of a radiosensitive dielectric material, such as thallium bromide, sandwiched between upper and lower metal layers. This film can be about ten microns thick or less, so as to be thin enough to be radiolucent, but still produce sufficient charge carriers under exposure to x-ray or gamma ray radiation. A phototimer circuit arrangement coupled to the metal layers can be configured as a current amplifier or as a voltage amplifier. A cooling arrangement can be incorporated to maintain the sensor at a low temperature to reduce or eliminate thermally activated dark current. The phototimer can be incorporated into a large area radiological imager.

19 Claims, 4 Drawing Sheets

PHOTOTIMER FOR RADIOLOGY IMAGING

BACKGROUND OF THE INVENTION

This invention relates to techniques for measuring radiation exposure or dose, and is more particularly concerned with techniques for controlling the time of exposure for an X-ray generator, e.g., for obtaining an optimal image. The invention is more particularly concerned with a phototimer that is sensitive to the flux of x-ray radiation on an imaging medium, and can be interposed between the radiation source and the imaging medium without stopping a significant portion of the incident radiation flux.

At the present time there exists a need to control the exposure time for radiology imagers, so that an excellent image can be produced in each exposure. This serves both to reduce the total exposure of the patient to radiation, and to reduce or eliminate overexposure or underexposure of radiological images.

It is now common to employ an image intensifier and a video camera to obtain radiological images. The image intensifier produces a continuous image whose quality can be monitored, and it is possible control the exposure by viewing the image itself. However, for a variety of reasons other techniques have begun to be employed. Among these are large-area x-ray or gamma ray imaging tubes, examples of which are described in Nudelman et al. U.S. Pat. Nos. 5,195,118 and 5,306,907. In addition, there are flat panel imagers, an example of which is described in Antonuk et al. U.S. Pat. Nos. 5,079,426 and 5,262,649. In these imaging tubes and flat panel imagers, the radiological image is formed as a charge image on a substrate that is sensitive to high energy photons of x-rays or gamma rays, and then the charge image is scanned to produce a high quality video signal. In order to produce high quality radiological images of good contrast, a so-called spot imaging technique is often employed. Here a charge image is formed by passing a flux of radiation through the patient or other subject onto the imaging plate. Then, after a sufficient exposure, the imaging plate is scanned to obtain a high quality output signal. Because the image signal is not produced until after exposure is complete, the image output signal cannot provide exposure control directly. For that reason another exposure control technique has to be used. For similar reasons, it is impossible to control exposure time directly when conventional silver halide film is used to capture the image. For flat panel imagers, a scintillation medium is used in close proximity to the light-sensing array, and direct light measurement is difficult at best. Accordingly an exposure control technique is needed for a variety of imaging mediums to obtain consistent high quality images.

In order to sense the total radiation flux that is incident upon the radiological imaging medium, the phototimer sensor should be situated between the patient or subject being examined and the imaging medium. Consequently, the phototimer sensor should be radiolucent (that is, transparent to the wavelengths in question), so that most of the radiation flux passes through to the imaging medium. The ideal phototimer should have the following basic performance characteristics: (a) no loss of x-ray energy (dose), i.e., perfect radio-lucence (a corollary of this is that x-rays are not scattered in the phototimer sensor); (b) output signal level linearly proportional to x-ray dose; (c) sensing area can be arbitrarily large or small, so as to match up with the area being imaged; and (d) infinite dynamic range. However, to date phototimer sensors or phototimer circuits with characteristics even approaching these have eluded the industry.

OBJECTS AND SUMMARY OF THE INVENTION

Accordingly, it is an object of this invention to provide a phototimer for use with an x-ray or gamma ray imaging system that accurately controls the radiation flux to obtain optimal exposure, and which avoids the drawbacks and pitfalls of the prior art.

It is a more specific object to provide a phototimer which is of simple and straightforward design, of rugged construction and of high reliability.

It is a further object to provide a phototimer with a sensor that is highly radio-lucent, having an output that is substantially linear with respect to radiation flux passing through it, whose sensing area can be selected for a given application, and having a wide dynamic range.

According to an aspect of this invention, a phototimer for x-rays or gamma rays, incorporates a thin film of thallium bromide or a similar radiosensitive dielectric material sandwiched between metal layers to form a capacitor, and must be deposited thinly enough to be radiolucent. On the other hand, this layer must provide sufficient sensitivity to behave as a timer. The metal layers, which can be a metal film, serve as capacitive plates or terminals for the capacitor. The dielectric material is sufficiently thin so as to be substantially radiolucent, e.g., on the order of about ten microns or less. This material produces charge carriers (i.e., holes and electrons) under exposure to a flux of x-ray or gamma ray radiation, so that the voltage that exists between the two metal layers varies linearly with the radiation flux that has passed through the layer of thallium bromide. A phototimer circuit has inputs operatively coupled to the two metal layers and produces an output that represents the flux of said radiation through said film. This circuit can be employed to shut off an x-ray generator, for example, when the phototimer sensor reaches a threshold voltage. The film of radiosensitive material can be selected from a group of candidate materials having good x-ray photon absorption, a high number of charge carriers per absorbed photon, and low dark conductivity. A number of suitable materials exist in addition to TlBr, for example, TlI, Se, $PbBr_2$ and $PbI_2$, all fitting the above requirements. There are other likely candidates not mentioned here.

Cooling means, e.g., a thermoelectric cooling ring, can be incorporated and placed in thermal contact with the phototimer sensor for maintaining the film and metal layers at a reduced temperature, e.g., about minus 20 degrees C. This minimizes dark current due to thermal effects in the photosensitive thin film. The phototimer sensor can be cooled to a still lower temperature for further reduction in dark current, if needed.

The upper one of the two metal layers can be configured to accommodate multiple fields of view corresponding to typical image area sizes used in radiological imaging applications. This can be accomplished by segmenting the upper metal layer into portions, e.g., concentric rings, or a grid of rectangles. Typical image intensifier based radiological imagers may provide as many as four fields of view, ranging from "Full Field" (100% of available imaging area) to "Mag Mode 3" (as little as the central 25% of the available imaging area). In contrast, emerging flat panel imagers will have the ability to select arbitrary-size rectangular fields of view located anywhere within the available imaging area.

The phototimer circuit can be a current-sensing constant bias circuit. In that case a current amplifier has an input coupled to the upper metal layer and an output coupled to a load. An offset amplifier can be coupled to the output of the current amplifier. The output is generally proportional to x-ray flux-induced current produced in the dielectric TlBr film. Alternatively, the phototimer circuit can be a voltage sensing arrangement, including a switch for imposing a first predetermined voltage between the metal layers or capacitor plates. A comparator has inputs coupled to the two metal layers and an output which indicates when the voltage between the metal layers, and across the TlBr film, has decayed to a second predetermined voltage as a result of absorbed x-ray photons.

The phototimer of this invention could be implemented by depositing a thin film of radiosensitive material on a suitable radiolucent substrate such as a thin sheet of aluminum (25 mils or less). The top contact could be a thinly deposited layer of a suitable metal which is also radiolucent. The aluminum substrate could be cooled to −20° C. or below using a cooled area of the material around the periphery of the substrate. That is waste heat would be conducted to a ring of themoelectric cooling conductive material at the periphery, e.g., a Peltier-effect cooling device.

The phototimer of this invention can also be incorporated directly into a large-area scanning camera suitable for exposure to a flux of x-rays or gamma rays, for example of the type described in the aforementioned U.S. Pat. Nos. 5,195,118 and 5,306,907. The camera of this type includes an evacuated enclosure, an imaging layer of a radiosensitive dielectric material positioned in an imaging plane within the enclosure, and a radiolucent metal support (e.g., an aluminum plate) on which the radiosensitive dielectric material is deposited. A thermoelectric cooling arrangement, e.g., a Peltier-effect cooling arrangement, within the enclosure is in thermal contact with the metal support to maintain the metal support and imaging layer at a reduced temperature (e.g., minus 20 degrees) to reduce film conductivity (and hence, dark current) in the radiosensitive material. An electron beam arrangement or other scanning mechanism is employed for extracting from the imaging layer an electrical signal representing the image that is formed on said imaging layer under exposure to a flux of x-ray or gamma ray radiation. The phototimer mechanism of this invention is situated within said enclosure in advance of said imaging layer. In that case the phototimer sensor can be formed directly upon a proximal surface of the aluminum plate, the imaging layer being located on the distal surface thereof. The aluminum plate can serve as the lower metal layer, with an aluminum film being deposited on the TlBr film as the upper metal layer. Conductors or leads pass out of the enclosure to the associated phototimer circuitry. The same or a similar arrangement can be incorporated into a flat panel x-ray imager, e.g., of the type described in U.S. Pat. Nos. 5,079,426 and 5,262,649.

The above and many other objects, features, and advantages of this invention will be more fully understood from the ensuing detailed description of selected preferred embodiments, which description should be read in conjunction with the accompanying Drawing.

DETAILED DESCRIPTION OF THE PREFERRED EMBODIMENTS

Figure 1:
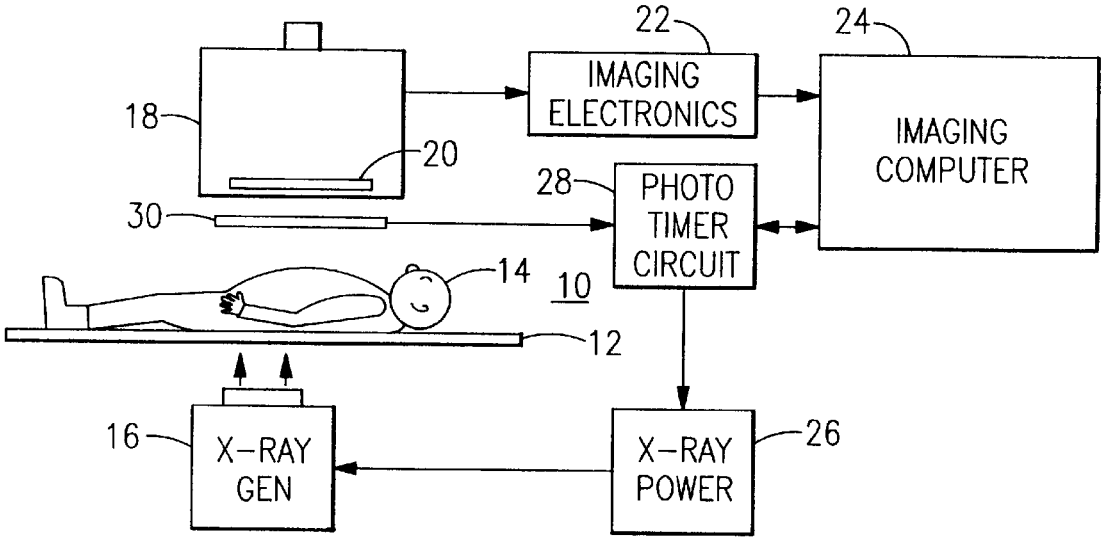
FIG. 1 is a schematic elevation of radiology imaging apparatus in which can be incorporated the phototimer according to an embodiment of the invention.
Figure 2:
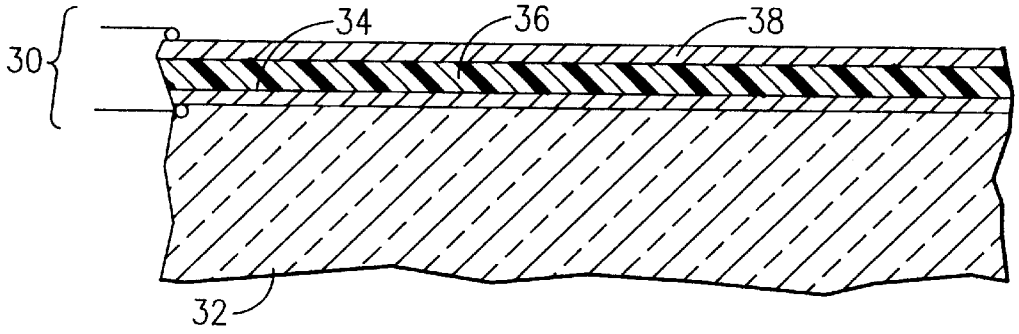
FIG. 2 is a cross section showing the structure of a phototimer structure according to an embodiment of the invention.

With reference to the Drawing, and initially to FIG. 1 thereof, a radiology imaging station 10 has a horizontal stage or table 12 on which a human patient 14 rests. An x-ray generator 16 is positioned beneath the patient 14 and directs a beam of radiation upwards through a section of the patient 14 that is to be examined. A large area imaging tube 18 is positioned above the stage or table 12 and in registry with the beam from the x-ray generator 16. In one of many possible implementations, the imaging tube can comprise an imaging plate 20 having a layer of a sensitive material on its distal side (i.e., above the plate, or away from the x-ray generator). Situated distally within the tube 18 is scanning means, e.g., an electron beam generator, which creates a raster scan of the surface of the imaging plate to generate an image signal. One favorable arrangement is discussed in U.S. Pat. No. 5,195,118, mentioned above. The image signal is fed from the tube 18 to imaging electronics 22, which produces a video signal. The latter is supplied to an imaging computer 24, which can be of selected from a variety of known configurations. The imaging computer 24 is also coupled to an x-ray power supply 26 and a phototimer circuit 28, which is in turn coupled to the power supply 26. The phototimer circuit 28 controls the exposure time for the power source and associated x-ray generator 16, that is, by shutting off the generator 16 when the phototimer circuit has detected that an optimal amount of x-ray flux has passed through the patient 14 to the imaging tube 18. To accomplish this, a phototimer sensor 30 is positioned in advance of the imaging plate 20 and outside the tube envelope 18 (or optionally incorporated into the camera itself within the envelope). The phototimer sensor 30 is in the form of a capacitor, made up of a dielectric film with metallization on its upper and lower surfaces. In order to detect radiation flux, the dielectric is selected from materials which are sensitive to the passage of x-rays (or gamma rays) through them. Thallium bromide is one acceptable material, as it generates pairs of holes and electrons under exposure to x-ray radiation. For a rather broad dynamic range, the number of charge carriers produced in the material is fairly linear with respect to radiation flux. Other materials with good x-ray photon absorptivity, high charge generation per absorbed photon, and low conductivity, are considered to have acceptable radiosensitivities, and can also be used. In the case of TlBr, a thick film of 100 to 200 microns will stop, i.e., attenuate, radiographic doses of x-ray radiation. The absorption of x-rays is substantially linear for TlBr, so a thickness of ten microns or less, and preferably less than two microns, and more preferably below one micron, will attenuate less than ten percent of the incident radiation, depending upon photon energy. The resulting output signal can achieve a reasonable signal-to-noise ratio, by adjusting capacitor bias, control of dark current, and sensitivity of the associated electronic circuitry. The aluminum metallization is substantially transparent to x-ray radiation (i.e., radio-lucent). As shown in FIG. 2, this thin film TlBr capacitor-structure sensor 30 can be constructed by forming, on a suitable substrate 32 (i.e., glass, aluminum, or other radio-lucent metal) a bottom metallization layer 34. Then the thallium bromide thin film 36 is deposited over the bottom metallization, followed by a second or top metallization 38. The two metallizations 34, 38 serve as first and second capacitor plates. Here, the substrate 32 is shown as glass. If this substrate is aluminum, the upper surface of the aluminum could serve as the bottom metallization.

Here the metallization layers 34 and 38 are made thin enough to be transparent for low x-ray doses, i.e., those typical for fluoroscopy and dental radiology, yet are conductive enough to behave as lumped capacitor terminals. The thallium bromide layer has an inherent high "gain" (e.g., between about 5,000 and 10,000 electrons per x-ray photon) which permits the formation of measurable charge levels, even when very small amounts of x-rays are being stopped in the film layer 36. The film 36 is preferably deposited as a high purity, stoichiometric thallium bromide layer. This can be achieved by any of a number of chemical deposition techniques.

The area covered by the film 36 and metallization layers 34 and 38 can be made identical and deposited in any desired shape, e.g., to correspond to the irradiated area or zone. It is likewise possible to form the sensor 30 to cover the entire sensitive imaging area 20 of the imaging device 18.

Figure 3:
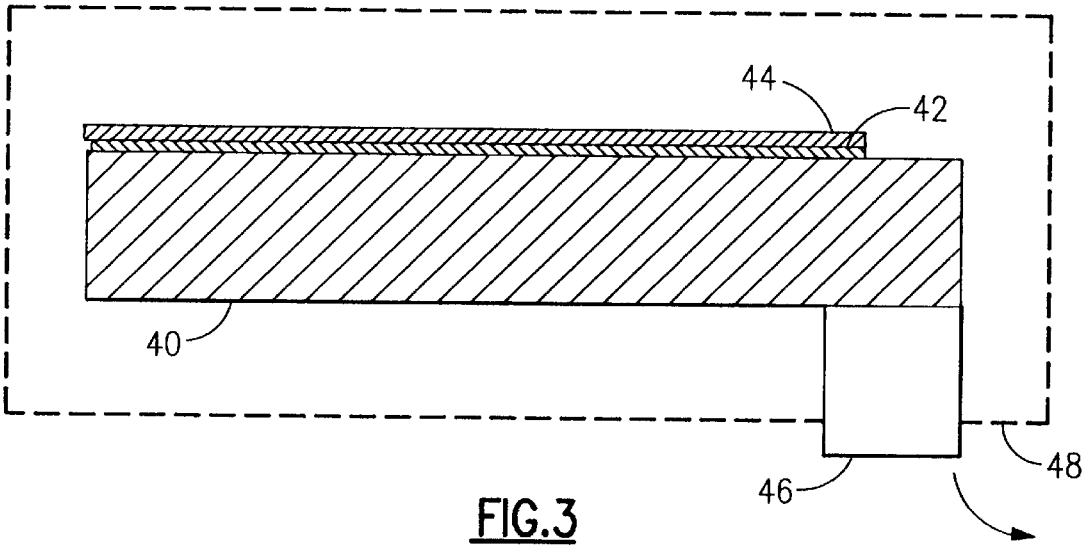
FIGS. 3 and 3A are cross sections showing other embodiments of this inventions.

FIG. 3 illustrates a phototimer with included means for reducing its operating temperature about 40 degrees C. below ambient to decrease its conductivity. Here an aluminum support plate 40, which is radiolucent, supports a TlBr film 42 on which is deposited an upper metallization layer 44. A thermoelectric cooling arrangement 46, i.e. cold fingers, is in thermal contact with the aluminum support plate 40 and also in thermal contact with an external heat sink (not shown). This arrangement can be contained within a sheath or envelope 48. The thermoelectric cooling arrangement 46 maintains the support plate 40 at about forty degrees C. below ambient, which improves the phototimer output signal by reducing background conductance due to thermal effects.

Figure 3A:
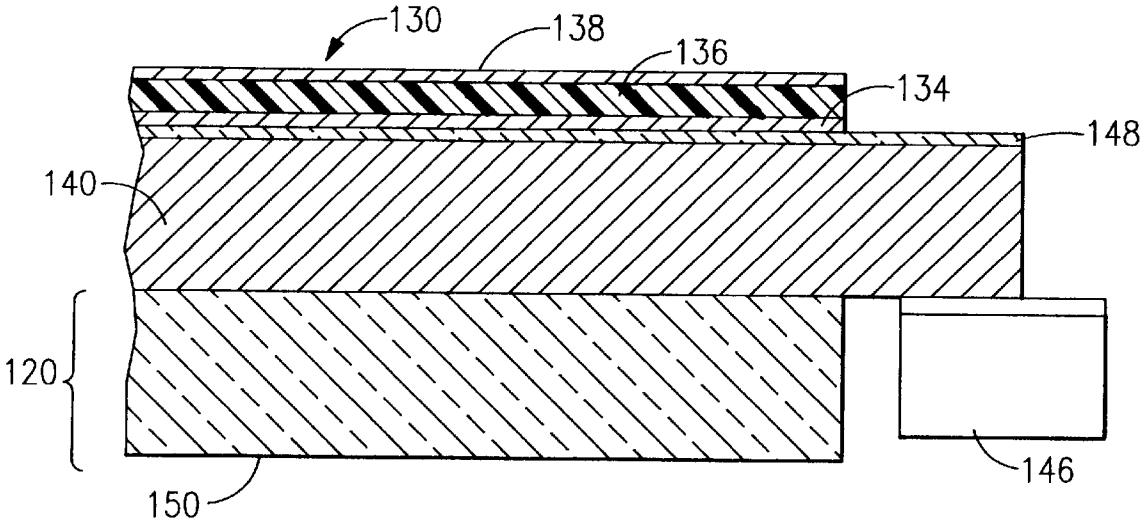

FIG. 3A shows the general construction of a combination of the x-ray imager and phototimer sensor sharing a common substrate. Here, the elements described above in reference to FIGS. 2 and 3 are identified with similar reference numerals but raised by 100, and a detailed description need not be repeated. An imager 120, which can, for example, be constructed generally according to U.S. Pat. No. 5,195,118 or 5,306,907 mentioned above, includes an aluminum support plate 140 that serves as a conductive radiolucent substrate, and a TlBr imaging layer 150 is formed on its under side, i.e., the distal side with respect to the x-ray source. This layer 150 is typically at least about 200 microns thick. A thermo-electric cooling arrangement 146 is in thermal contact with the plate 140, and maintains the plate 140 and imaging layer 150 at a temperature that is reduced below ambient, e.g, about minus 20° C. or below. This reduces thermal production of electron-hole pairs in the layer 150, i.e., reduces the so-called dark current, so that the electron-hole production in the layer 150 is substantially entirely due to the passage of radiation flux into the imaging layer. The construction of the thermo-electric cooling arrangement is well known, and need not be described here in detail. Here the phototimer 130 is piggy-backed onto the aluminum plate 140 of the imager 120, so that the thermo-electric cooling arrangement 146 performs two functions. That is the thermo-electric cooling arrangement cools the imager and also cools the phototimer, to improve the performance of both.

On the upper, or proximal side of the plate 140 is formed the phototimer sensor 130 according to an embodiment of this invention. An upper surface of the plate 140 can serve as the bottom metallization. However, here there is provided a thin insulating film layer 148 (In other possible embodiments, this insulating layer can be omitted). The bottom metallization 134 is deposited on this insulating film. The bottom metallization 134 can be provided with a ground contact. Atop this layer 134 lies the thallium bromide film 136, in this example about 1 $\mu$m in thickness, with the upper metallization layer 138 being deposited atop this film 136. The aluminum plate 140 is sufficiently conductive, thermally, so that the cooling arrangement 146 also keeps the sensor 130 at a reduced temperature, e.g., −20° C., to reduce or eliminate dark current in the TlBr film 136. This makes the sensor 130 highly sensitive to incident x-ray radiation flux.

Figure 4:
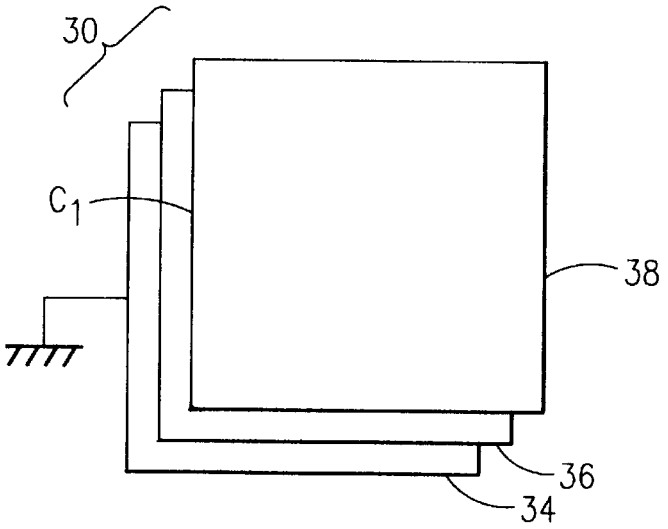
FIGS. 4, 5, and 6 are schematic plan views respectively illustrating embodiments of the phototimer sensor, showing a full field configuration, and two concentric reduced fields of view, referred to as Mag Mode 1 and Mag Mode 2.
Figure 5:
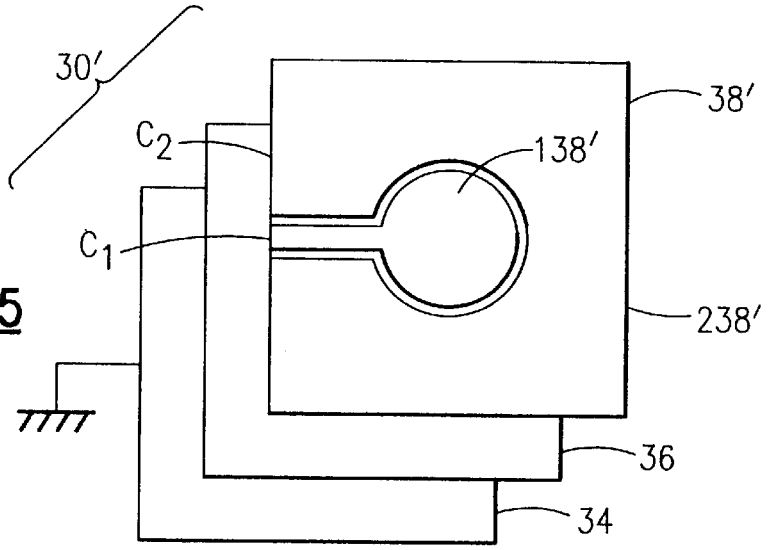
Figure 6:
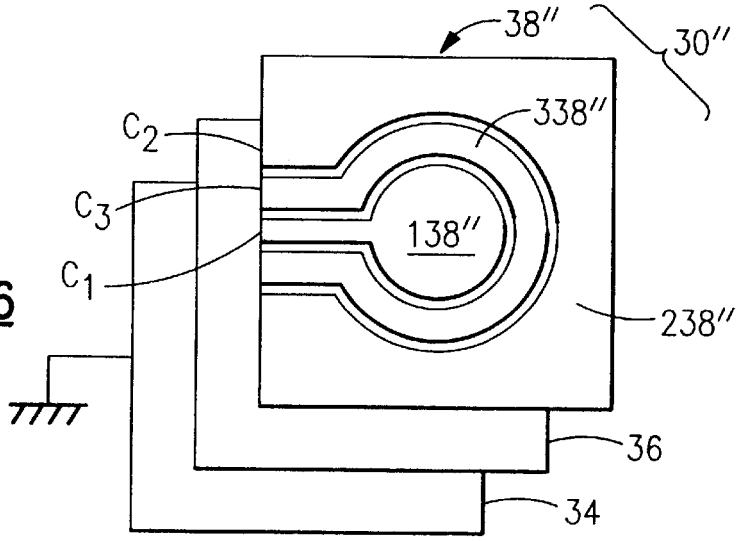

As shown in FIGS. 4, 5, and 6, the phototimer sensor of this invention can be shaped to cover all or selected portions of the irradiated area, depending on the imaging requirements. As shown in FIG. 4, the sensor can be formed with a single, unitary upper metallization layer 38, with a single capacitor terminal $C_1$. The lower metallization 34 is here considered as ground. This configuration integrates the charge formed in the film 36 over the entire area of the upper metallization, and produces a "full field" averaging reading of the x-ray exposure.

When taking x-ray images of human tissue, only the area of interest should receive a dose of radiation. The usual practice then is to limit the area being exposed to x-rays, using collimation or shielding. The area of the phototimer that is used for spatial integration should likewise be limited so that the exposure and dosage can be controlled accurately. For that reason the phototimer sensor geometry can be configured as in these examples.

FIG. 5 shows a similar sensor 30' but arranged for a single reduced FOV (field of view) (i.e., central portion of image area) and full field exposure measurements. Here, the upper metallization has a central disk portion 138' with a second metallization portion 238' disposed around the disk portion 138' and isolated from it. Each portion 138', 238' has a respective capacitor terminal $C_1$, $C_2$. This arrangement permits exposure measurement and control for a central reduced FOV. Alternatively, the two portions 138', 238', can be integrated together to obtain a full field averaging reading, i.e., with a single output for the entire imaging area.

FIG. 6 shows a third possible arrangement of the sensor 30", here permitting two different reduced FOVs in addition of a full-field FOV. The upper metallization 38" has a central spot or disk portion 138", an outer peripheral portion 238", and a ring portion 338" interposed between the two. These are electrically isolated from one another, and have respective terminals $C_1$, $C_2$, and $C_3$. These can be employed independently, or integrated together. The smallest FOV would utilize portion 138" alone. The intermediate sized FOV would integrate portion 138" with portion 338". The full-field FOV would integrate all three terminals together.

The configurations of FIGS. 4, 5, and 6 here form one, two, or three separate capacitors. The metallization on both surfaces of the thallium bromide film 36 permits the capacitor(s) to spatially integrate the charge developed in the film 36, and the collected charges are sensed at a single point, e.g., $C_1$. This spatial integration combines with the inherent temporal integration of the sensor 30, 30' or 30". This is a distinctly different application from the imaging function performed by the TlBr imaging layer 124, where spatial integration is undesirable. The metallizations 38, 38', 38" are here shown on the upper layer as a matter of convenience of explanation and illustration. It is to be understood that the sensor 30, 30' or 20" could easily be positioned in any orientation.

The phototimer circuitry 28 can be configured in at least two fundamentally different ways to sense the charge formed in the thallium bromide phototimer sensor 30. As show in the following examples, two of these ways can be current sensing and voltage sensing.

Figure 7:
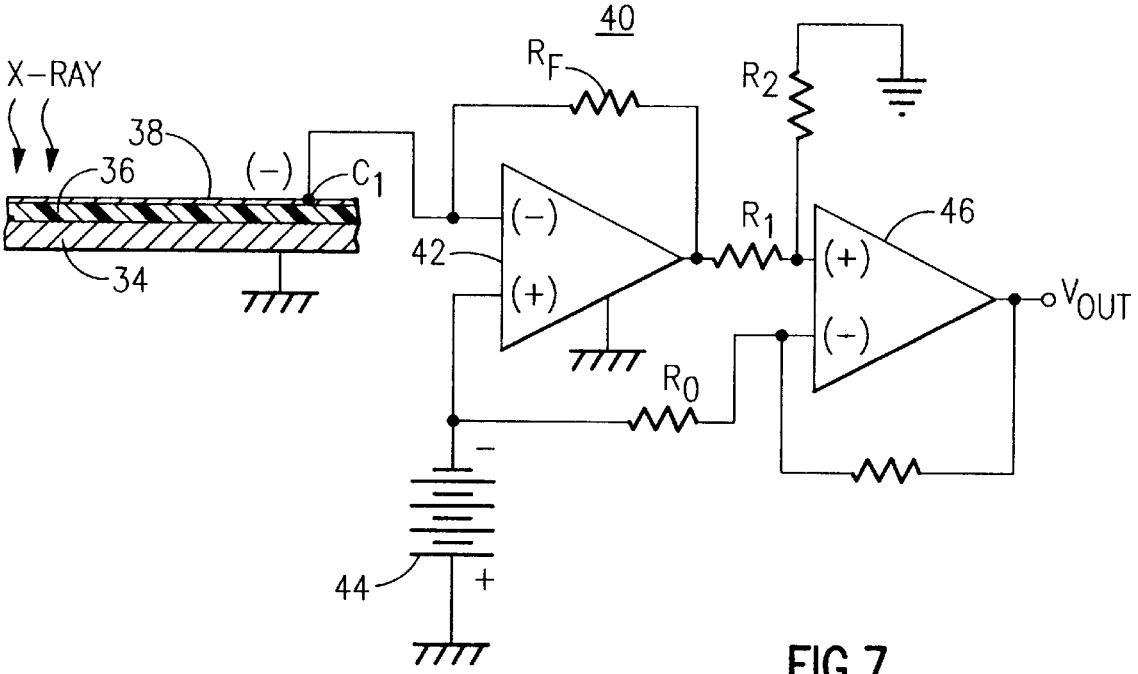
FIG. 7 is a schematic diagram of a phototimer circuit for constant bias current sensing operation.

As shown in FIG. 7, a current sensing circuit 40 maintains a constant (negative) voltage bias on the upper metallization layer 38. As x-ray photons impact the thallium bromide and cause positive charges to form, these charges are neutralized by electrons provided by a current-sense amplifier 42, here shown as an op amp, with a bias source 44 coupled to a second terminal thereof The output of the amplifier 42 is fed through load resistors $R_1$, and $R_2$. An offset amplifier 46 has an input connected to the junction of the resistors $R_1$, and $R_2$, and a bias terminal connected to the bias source 44 through resistor $R_0$. The output of the amplifier 42 is generally proportional to the instantaneous net x-ray photon-induced current within the thallium bromide film 36. However, this current will have an initial offset equal to the bias voltage plus the instantaneous dark current times the value of a feedback resistor $R_F$ situated between the output and input of the amplifier 42. The offset amplifier 46 creates a proportional output without the initial offset voltage. Of course, the dark current can be measured with the generator 16 off to calibrate the amplifier output.

This sensing arrangement does not temporally integrate the total x-ray induced charge, nor does it integrate the dark current. Therefore, this arrangement is suitable where long sensing times or a wide dynamic range are needed. Additional electronics, not shown here, can be added to integrate the output voltage signal over time, after first correcting for the dc component due to dark current, thereby producing an output proportional to total dose.

Figure 8:
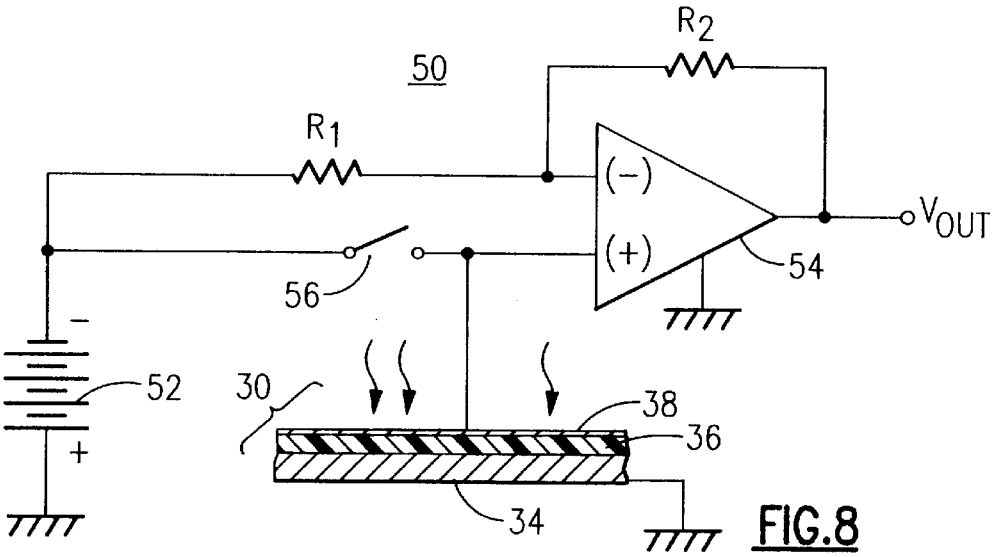
FIG. 8 is a schematic diagram of a phototimer circuit for switched bias voltage sensing operation.

Another sensing circuit arrangement 50 for sensing the charge in the thallium bromide film 36 is shown in FIG. 8. Here, a bias source 52 is coupled through an input resistor $R_1$ to an input terminal of a voltage amplifier 54, and through a switch 56 to another input terminal of the amplifier 54 and to the upper metallization layer 38 of the phototimer sensor 30. In this voltage sensing approach, the switch 56 is momentarily closed to impose the bias voltage $V_{bias}$ from the source 52 onto the TlBr film 36. The amplifier 54 is a high-impedance amplifier and senses the decaying voltage across the capacitor, i.e., the sensor 30, without an offset voltage. The bias voltage $V_{bias}$ has to be selected high enough to ensure that the voltage across the film 36 will not be drawn down to zero during the sensing period. For many radiological applications, a bias voltage of ten volts can be used. This can be set to a higher value for greater exposure times. Thermally induced dark current within the thallium bromide film will also neutralize some of the charge and will contribute to the reduction of the initial capacitor voltage. Thus, the output of the amplifier 54 will be proportional both to the x-ray induced charge and also the thermally induced dark current. Circuitry downstream of the amplifier (not shown) can be calibrated to account for the dark current component. However, as mentioned above, cooling the sensor 30 will reduce the dark current component to an insignificant level, and that approach is preferred.

The amplifier 54 can also be configured as a comparator, which will send out a shut-off signal to the x-ray power supply 26 when the voltage at the input has decayed to a predetermined threshold voltage, corresponding to a predetermined radiation flux value.

While this invention has been described hereinabove with reference to several preferred embodiments, it should be understood that the invention is not limited to those precise embodiments. Rather, many modifications and variations would present themselves to persons skilled in the art without departing from the scope and spirit of this invention, as defined in the appended claims.

I claim:

1. Phototimer for x-rays or gamma rays, comprising a film of a radiosensitive dielectric material sandwiched between a first radiolucent metal layer and a second radiolucent metal layer; said dielectric material being sufficiently thin so as to be substantially radiolucent but producing charge carriers under exposure to a flux of x-ray or gamma ray radiation; and phototimer circuit means having inputs operatively coupled to said first and second metal layers and producing an output which represents spatial integration of the flux of said radiation through said film.

2. Phototimer for x-rays or gamma rays according to claim 1, wherein said film of radiosensitive material is selected from the group that consists of TlBr, TlI, Se, $PbBr_2$ and $PbI_2$.

3. Phototimer for x-rays or gamma rays according to claim 1 wherein said film of radiosensitive material is TlBr.

4. Phototimer for x-rays or gamma rays according to claim 3 wherein said TlBr film is about 10 microns thick or less.

5. Phototimer for x-rays or gamma rays according to claim 1 further comprising cooling means for maintaining said film and metal layers at a reduced temperature to minimize dark current in said film.

6. Phototimer for x-rays or gamma rays according to claim 1 wherein said phototimer circuit means is in the form of a current-sensing constant bias circuit, comprising a current amplifier having an input coupled to said first metal layer and an output coupled to a load, and an offset amplifier coupled to the output of said current amplifier, such that the offset amplifier output is generally proportional to instantaneous radiation-induced current produced in said film.

7. Phototimer for x-rays or gamma rays according to claim 1 wherein said phototimer circuit means includes switched means for imposing a first predetermined voltage between said first and second metal layers, and voltage amplifier means having inputs coupled to the first and second metal layers and an output providing an output signal related to the flux of said radiation incident on said film and integrated over time.

8. Phototimer for x-rays or gamma rays according to claim 7 wherein said voltage amplifier means is configured as a comparator for indicating when the voltage between said metal layers has decayed to a second predetermined voltage.

9. Phototimer for x-rays or gamma rays according to claim 1 wherein said first metal layer includes a first region and a second region adjacent to and electrically isolated from said first region, with separate respective electrodes connected thereto.

10. Phototimer for x-rays or gamma rays according to claim 9 wherein the first region of said first metal layer is a central spot region and the second region is a marginal region disposed around the periphery of said first region.

11. Phototimer for x-rays or gamma rays according to claim 10 said first metal layer further including a third region interposed between said first and second regions and having an associated third electrode.

12. Phototimer for x-rays or gamma rays according to claim 1 wherein said first metal layer is formed as a plurality of regions that are electrically isolated from each other, with respective separate electrodes connected thereto.

13. A phototimer for x-rays or gamma rays comprising a radiolucent metal support plate; a film of a radiosensitive dielectric material sandwiched between a first metal layer and a second metal layer, and in thermal contact with said metal support plate; cooling means in thermal contact with said metal support plate for maintaining said metal support at a reduced temperature to reduce conductivity in said radiosensitive dielectric material; said film being sufficiently thin so as to be substantially radiolucent, but producing charge carriers under exposure to a flux of x-ray or gamma ray radiation; and phototimer circuit means having inputs operatively coupled to said first and second metal layers and producing an output signal which is a function of the flux of said radiation through said film.

14. The phototimer according to claim 13, wherein said film is TlBr.

15. The phototimer according to claim 14, wherein said TlBr film is about ten microns thick or less.

16. In a large-area scanning camera suitable for use with exposure to a flux of x-rays or gamma rays, including an evacuated enclosure, an imaging layer of a radiosensitive dielectric material positioned in an imaging plane within said enclosure, a radiolucent metal support on which said radiosensitive dielectric material is disposed; cooling means within said enclosure and in thermal contact with said metal support for maintaining said metal support and said imaging layer at a reduced temperature to reduce conductivity in said radiosensitive material; and scanning means for extracting from said imaging layer an electrical signal representing an image on said imaging layer that is formed under exposure to a flux of x-ray or gamma ray radiation; the improvement which comprises a phototimer for x-rays or gamma rays situated within said enclosure in advance of said imaging layer and including a film of a radiosensitive dielectric material sandwiched between a first metal layer and a second metal layer, and in thermal contact with said metal support; said film of dielectric material being sufficiently thin so as to be substantially radiolucent, but producing charge carriers under exposure to a flux of x-ray or gamma ray radiation; and phototimer circuit means having inputs operatively coupled to said first and second metal layers and producing an output to control the exposure to said radiation as a function of the flux of said radiation through said film.

17. The scanning camera according to claim 16, wherein said film is disposed directly on one surface of said metal support, which surface serves as said second metal layer.

18. The scanning camera according to claim 16, wherein an insulating film is interposed between said metal support and said second metal layer.

19. The scanning camera according to claim 16, wherein said film of radiosensitive dielectric material is about ten microns thick or less.

* * * * *